US008517695B2

(12) United States Patent
Lee et al.

(10) Patent No.: US 8,517,695 B2
(45) Date of Patent: Aug. 27, 2013

(54) VARIABLE DISPLACEMENT SWASH PLATE TYPE COMPRESSOR

(75) Inventors: Geon-ho Lee, Seongnam-si (KR); Tae-jin Lee, Incheon (KR); Ki-beom Kim, Anseong-si (KR)

(73) Assignees: Doowon Technical College (KR); Doowon Electronic Co., Ltd. (KR)

( * ) Notice: Subject to any disclaimer, the term of this patent is extended or adjusted under 35 U.S.C. 154(b) by 406 days.

(21) Appl. No.: 12/743,591

(22) PCT Filed: Nov. 13, 2008

(86) PCT No.: PCT/KR2008/006696

§ 371 (c)(1), (2), (4) Date: May 19, 2010

(87) PCT Pub. No.: WO2009/066902

PCT Pub. Date: May 28, 2009

(65) Prior Publication Data

US 2010/0282071 A1 Nov. 11, 2010

(30) Foreign Application Priority Data

Nov. 21, 2007 (KR) ..... 10-2007-0119328

(51) Int. Cl.
*F04B 1/00* (2006.01)

(52) U.S. Cl.
USPC ..... 417/271; 92/12.2; 92/13; 91/505; 91/506; 91/472; 91/499

(58) Field of Classification Search
USPC ..... 417/269, 271; 91/472, 499, 505, 91/506; 92/12.2, 13
See application file for complete search history.

(56) References Cited

U.S. PATENT DOCUMENTS 5,336,056 A * 8/1994 Kimura et al. ..... 417/222.1
5,370,505 A * 12/1994 Takenaka et al. ..... 417/269

(Continued)

FOREIGN PATENT DOCUMENTS

JP 2000-297746 10/2000
JP 2006-022785 1/2006

(Continued)

OTHER PUBLICATIONS

International Search Report. Mar. 25, 2009.

*Primary Examiner* — Charles Freay
*Assistant Examiner* — Christopher Bobish
(74) *Attorney, Agent, or Firm* — Ballard Spahr LLP

(57) ABSTRACT

Provides is a variable displacement swash plate type compressor comprising a drive shaft, a lug plate fixedly installed at one side of the drive shaft, a swash plate dispose at another side of the drive shaft and rotated by the lug plate to vary a tilt angle thereof, a sleeve reciprocally moving along the drive shaft to let the swash plate rotate, and a spring supported between the sleeve and the lug plate, characterized in that the variable displacement swash plate type compressor comprises a restriction ring installed around the drive shaft between the lug plate and the sleeve to contact with the swash plate at a maximum tilt angle of the swash plate, wherein an end of the restriction ring is contacted with the lug plate and another end of the restriction ring is supported by the spring. Thus, since the direct contact between the swash plate and the lug plate is prevented, when the swash plate reaches at the maximum tilt angle, it is possible to reduce the noise and the wear remarkably.

1 Claim, 4 Drawing Sheets

(56) References Cited

U.S. PATENT DOCUMENTS

| | | | | |
|---|---|---|---|---|
| RE35,878 | E * | 8/1998 | Kimura et al. | 417/222.1 |
| 6,932,582 | B2 * | 8/2005 | Hayashi et al. | 417/269 |
| 6,969,241 | B2 * | 11/2005 | Hayashi et al. | 417/269 |
| 6,979,182 | B2 * | 12/2005 | Hayashi et al. | 417/269 |

FOREIGN PATENT DOCUMENTS

| | | |
|---|---|---|
| KR | 10-2002-0044662 | 6/2002 |
| KR | 10-0606641 | 8/2006 |

* cited by examiner

Fig. 3
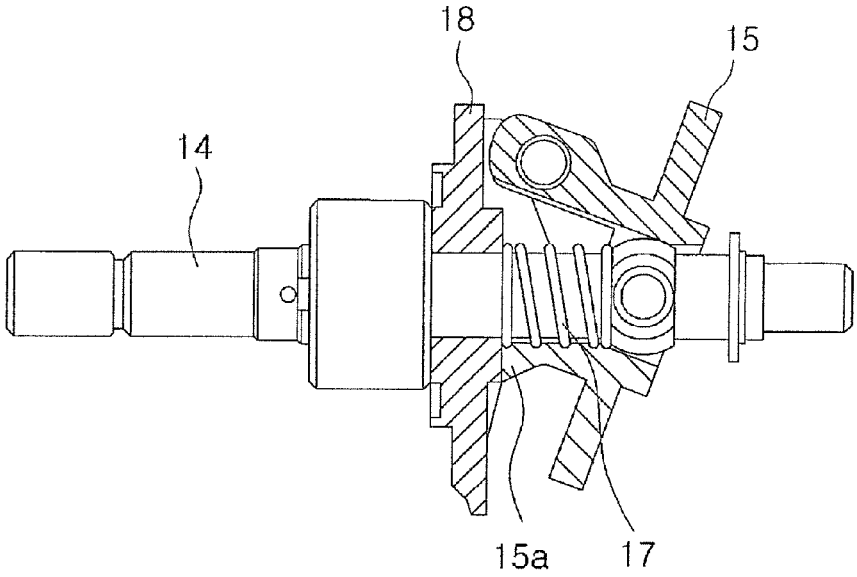
Fig.3A PRIOR ART
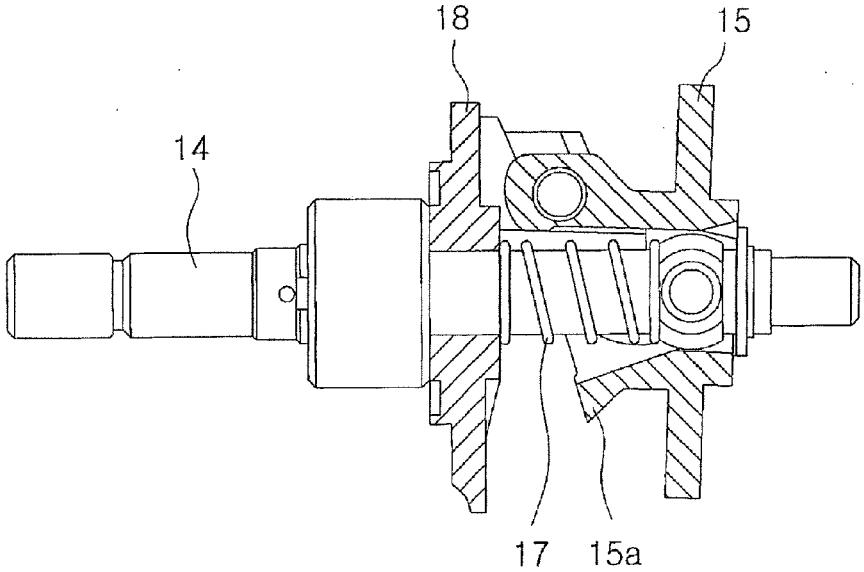
Fig.3B PRIOR ART

VARIABLE DISPLACEMENT SWASH PLATE TYPE COMPRESSOR

CROSS REFERENCE TO RELATED APPLICATIONS

The present application is a National Phase Application of International Application No. PCT/KR2008/006696, filed Nov. 13, 2008, which claims priority to Korean Patent Application No. 10-2007-0119328 filed Nov. 21, 2007, which applications are incorporated herein fully by this reference.

TECHNICAL FIELD

This present invention relates to a variable displacement swash plate type compressor, in particular, to a variable displacement swash plate type compressor having a restriction ring for a tilt angle.

BACKGROUND ART

Generally, a swash plate type compressor which mainly has been used for air conditioning systems of vehicles includes a disc shape of swash plate rotatably installed at a drive shaft receiving rotating power from an engine to change a tilt angle thereof, and a plurality of pistons arranged along a circumference of the swash plate via shoes while reciprocally moving in cylinder bores formed in a cylinder block to suck refrigerant gas, compress sucked refrigerant gas, and then discharge compressed refrigerant gas.

Recently, a variable displacement swash plate type compressor capable of accomplishing precise temperature control by controlling strokes of pistons due to changing a tilt angle of the swash plate depending on a change of thermal load has been proposed. At the same time, the tilt angle is continuously varied to reduce abrupt torque fluctuation of an engine caused by the compressor, thereby improving ride comfort of a vehicle.

In the Korean Patent Registration No.529716 (Patentee: Doowon Technical College, Doowon Electronic CO., Ltd), an exemplary embodiment of such a variable displacement swash plate type compressor is disclosed.

As shown in FIGS. 1 and 2, the variable displacement swash plate type compressor of the prior art includes a cylinder block 11 having a plurality of cylinder bores 11*a* formed in a longitudinal direction of the compressor and comprising a body portion of the compressor, a front housing 12 disposed at a front end of the cylinder block 11 to form a swash plate chamber 12*a*, a drive shaft 14 rotatably supported by the cylinder block 11 and the front housing 12, a lug plate 18 fixedly installed at the drive shaft 14 in a swash plate chamber 12*a* of the front housing 12, a rear housing 13 having a suction chamber 13*a* and a discharge chamber 13*b* and disposed at a rear end of the cylinder block 11, a swash plate 15 having a disc shape and being rotated by the lug plate 18 to vary a tilt angle thereof, a spring 17 supported between the lug plate 18 and the swash plate 15, and pistons 20 coupled to the swash plate 15 via shoes 21 to be slidably reciprocally accommodated in the cylinder bores 11*a*.

A suction port 16*a* and a discharge port 16*b* are respectively formed in a valve plate 16 installed between the rear housing 13 and the cylinder block 11, to respectively connect the cylinder bore 11*a* to the suction chamber 13*a* and the cylinder bore 11*a* to the discharge chamber 13*b*.

A suction valve (not shown) and a discharge valve (not shown) are respectively provided in a suction port 16*a* and a discharge port 16*b* to open and close the suction port 16*a* and the discharge port 16*b*, by a pressure change due to reciprocal movement of the pistons 20.

As shown in FIG. 3A, the spring 17 is supported between a sleeve 19 and the lug plate 18, the swash plate 15 being rotatably installed to the sleeve 19 which is located at the inside of the swash plate 15. The spring 17 pushes the swash plate 15 backward at normal times when external force is not applied so as to maintain a minimum tilt angle of the swash plate 15.

Accordingly, as shown in FIG. 3B, when the swash plate 15 is tilted, the sleeve 19 overcomes elastic force of the spring 17 and moves forward. And a lower stopper 15*a* of the swash plate 15 is contacted with the rear end of the lug plate 18.

DISCLOSURE OF INVENTION

Technical Problem

However, in the variable displacement swash plate type compressor of the prior art, as shown in FIG. 3B, when the swash plate is at the maximum tilt angle for driving of a maximum discharge capacity, impact noise is occurred while the stopper of the swash plate being contacted with the lug plate, in addition, the swash plate and the lug plate are worn.

An object of the present invention is to provide a variable displacement swash plate type compressor capable of preventing noise and wear from occurring by getting the swash plate not contacting directly with the lug plate at the maximum tilt angle of a swash plate.

Technical Solution

An aspect of the present invention provides a variable displacement swash plate type compressor comprising a drive shaft, a lug plate fixedly installed at one side of the drive shaft, a swash plate disposed at another side of the drive shaft and rotated by the lug plate to vary a tilt angle thereof, a sleeve reciprocally moving along the drive shaft to let the swash plate rotate, and a spring supported between the sleeve and the lug plate, characterized in that the variable displacement swash plate type compressor comprises: a restriction ring installed around the drive shaft between the lug plate and the sleeve to contact with the swash plate at a maximum tilt angle of the swash plate, wherein an end of the restriction ring is contacted with the lug plate and another end of the restriction ring is supported by the spring.

Here, a tube is extended from another end of the restriction ring along a longitudinal direction of the drive shaft, and disposed between the drive shaft and the spring.

Further, an vibration-reduction part may be formed at an end of the tube.

Still, the vibration-reduction part may be formed with vibration-reduction material to be attached to the end of the tube.

Still more, the restriction ring may be made of vibration-reduction material.

BRIEF DESCRIPTION OF DRAWINGS

The above and other objects, features and advantages of the present invention will be more apparent from the following detailed description taken in conjunction with the accompanying drawings, in which:

FIG. 3A is a side view showing a minimum tilt angle position of a swash plate of FIG. 1;

FIG. 3B is a side view showing a maximum tilt angle position of a swash plate of FIG. 1;

BEST MODE FOR CARRYING OUT THE INVENTION

Figure 1:
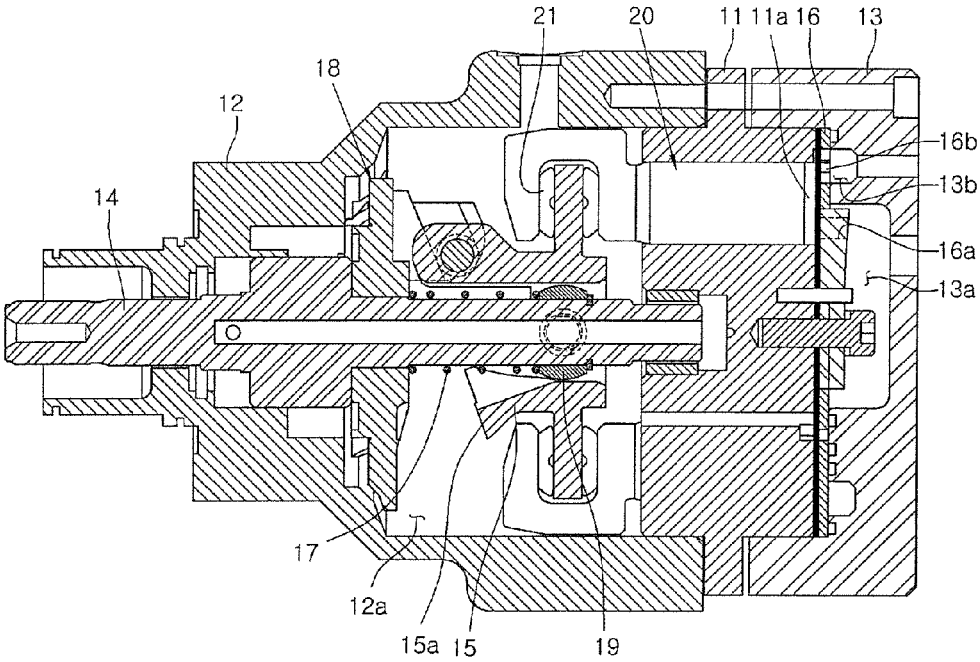
Fig. 1 PRIOR ART
FIG. 1 is a longitudinal view showing a variable displacement swash plate type compressor according to the prior art.
Figure 2:
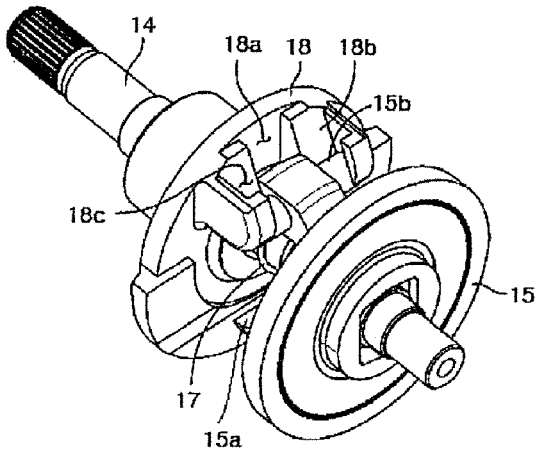
Fig. 2 PRIOR ART
FIG. 2 is a perspective view of FIG. 1.

Hereinafter, exemplary embodiments of the present invention will be described with reference to FIGS. 4 and 5. In detailing a variable displacement swash plate type compressor of the present invention, the components of the present invention that may be embodied in the above prior art are denoted by the same reference numerals as the prior art.

A variable displacement swash plate type compressor of the invention includes a cylinder block 11 having a plurality of cylinder bores 11*a* extended along a longitudinal direction of the compressor, a front housing 12 disposed at a front end of the cylinder block 11 to form a swash plate chamber 12*a*, a drive shaft 14 rotatably supported by the cylinder block 11 and the front housing 12, a lug plate 18 fixedly installed at the drive shaft 14 in the swash plate chamber 12*a* of the front housing 12, a rear housing 13 having a suction chamber 13*a* and discharge chamber 13*b* and disposed at a rear end of the cylinder block 11, a swash plate 15 having a disc shape and being rotated by the lug plate 18 to vary a tilt angle thereof, a spring 17 supported between the lug plate 18 and the swash plate 15, and pistons 20 coupled to the swash plate 15 via shoes 21 to be reciprocally accommodated in the cylinder bores 11*a*.

Here, since the cylinder block 11, the front housing 12, the rear housing 13, the spring 17, and the pistons 20 of the variable displacement swash plate type compressor have the same function as those of the above prior art, repeated details will be omitted.

For rotating the lug plate 18, both ends of the drive shaft 14 are respectively rotatably installed in the front housing 12 and the cylinder block 11, and the end of the drive shaft 14 installed in the front housing 12 is coupled to an engine (not shown) via a pulley (not shown) for transmission of power.

That is, a rotating power is transferred from the engine to the pulley to rotate the drive shaft 14.

Here, since the drive shaft 14 is the same constitution as that of the prior art, repeated details will be omitted.

The lug plate 18 is fixedly installed at one side of the drive shaft 14 to rotate the swash plate 15 and guide tilt movement of the swash plate 15.

The swash plate 15 letting the pistons 20 operate while varying the tilt angle thereof from a minimum tilt angle to a maximum tilt angle.

According to the present invention, a sleeve 19 is reciprocally installed around the drive shaft 14 along the longitudinal direction of the drive shaft 14. The sleeve 19 is relatively rotatably installed at an inside of the swash plate 15. Concretely, the sleeve 19 is straightly moveably installed along the drive shaft 14 and the swash plate 15 is rotatably installed to the sleeve 19.

A spring 17 is installed between the lug plate 18 and the sleeve 19 to elastically support the lug plate 18 and the sleeve 19.

A restriction ring 70 is installed around the drive shaft 14, between the lug plate 18 and the sleeve 19 to contact with the swash plate 15 at the maximum tilt angle. Thus, occurrences of the noise and the wear are remarkably reduced by preventing direct contact between the swash plate 15 and the lug plate 18.

The restriction ring 70 may be made of vibration-reduction material, such as rubber or silicon to significantly absorb the impact noise on impacting.

An end of the restriction ring 70 may be contacted with the lug plate 18 and another end thereof may be supported by the spring 17, thereby keeping the restriction ring 70 on a predetermined position without moving along the drive shaft 14.

A tube 72 may be extended from another end of the restriction ring 70 along the drive shaft 14, and an vibration-reduction part 71 may be protruded from an end of the tube 72.

Figure 4:
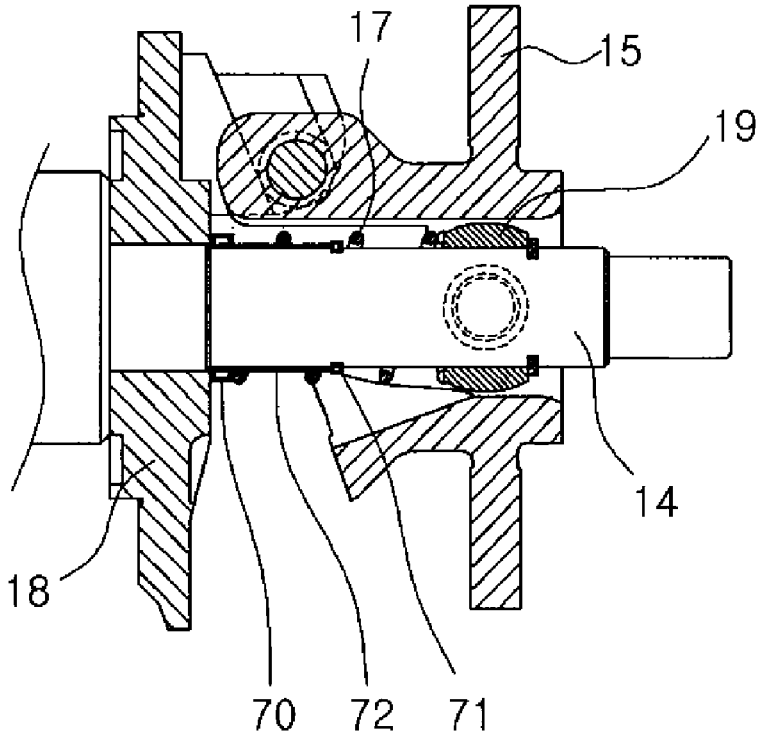
FIG. 4 is a longitudinal view showing a structure around a swash plate of a variable displacement swash plate type compressor according to a present invention.
Figure 5:
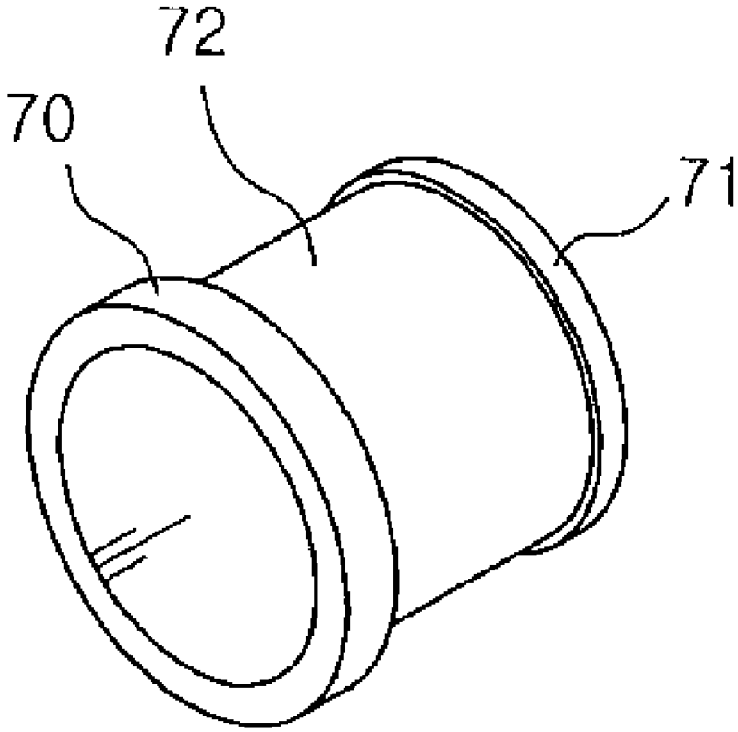
FIG. 5 is a perspective view showing a structure of a restriction ring of FIG. 4.

As shown in FIG. 4, the tube 72 is disposed at an inside of the spring 17, namely, between the drive shaft 14 and the spring 17.

Thus, since the sleeve 19 is contacted with the vibration-reduction part 71 at a moment in which the swash plate 15 is tilted at the maximum tilt angle while being moved forward, it is possible to prevent the impact noise from occurring on impacting. In particular, when the swash plate 15 reaches at the maximum tilt angle, since the vibration-reduction part 71 is disposed at the inside of the swash plate 15 to be covered with the swash plate 15, the impact noise between the sleeve 19 and the vibration-reduction part 71 is remarkably reduced.

The vibration-reduction part 71 may be comprised of vibration-reduction material such as rubber or silicon to be attached to the end of the tube 72. Alternatively, the restriction ring 70, the tube 72, and the vibration-reduction part 71 may be formed in a single body using an vibration-reduction material.

When the restriction ring 70, the tube 72, and the vibration-reduction part 71 are formed in the single body, it is possible to easily manufacture goods and effectively remove the noise.

Industrial Applicability

According to the above exemplary embodiments of the invention, it is possible to prevent the noise and wear from occurring by getting the swash plate not contacting with the lug plate at the maximum tilt angle of the swash plate.

While this invention has been described with reference to exemplary embodiment thereof, it will be clear to those of ordinary skill in the art to which the invention pertains that various modification may be made to the described embodiments without departing from the spirit and scope of the invention as defined in the appended claims and their equivalents.

The invention claimed is:

1. A variable displacement swash plate type compressor comprising a drive shaft, a lug plate fixedly installed at one side of the drive shaft, a swash plate disposed at another side of the drive shaft and rotated by the lug plate to vary a tilt angle thereof a sleeve reciprocally moving along the drive shaft to let the swash plate rotate, and a spring supported between the sleeve and the lug plate, characterized in that the variable displacement swash plate type compressor comprises:

a restriction ring installed around the drive shaft, wherein an end, of the restriction ring is contacted with the lug plate and another end of the restriction ring is supported by the spring so as to prevent direct contact between the swash plate and the lug plate, a tube extended along a longitudinal direction of the drive shaft from another end of the restriction ring and disposed between the drive shaft and the spring;

a vibration-reduction part that protrudes in a radially outward direction from one end of the tube, and the restriction ring protrudes in a radially outward direction from the other end of the tube;

wherein the restriction ring, the tube and the vibration-reduction part are made of one body and of vibration-reduction material; and wherein the vibration-reduction part is contacted with the sleeve at a maximum tilt angle of the swash plate and the restriction ring is contacted with the swash plate at a maximum tilt angle of the swash plate at the same time.

* * * * *

UNITED STATES PATENT AND TRADEMARK OFFICE

CERTIFICATE OF CORRECTION

PATENT NO. : 8,517,695 B2
APPLICATION NO. : 12/743591
DATED : August 27, 2013
INVENTOR(S) : Lee et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 471 days.

Signed and Sealed this
Fifteenth Day of September, 2015

Michelle K. Lee

Michelle K. Lee
*Director of the United States Patent and Trademark Office*